US009715199B2

(12) United States Patent
Yoshida et al.

(10) Patent No.: US 9,715,199 B2
(45) **Date of Patent: *Jul. 25, 2017**

(54) IMAGE FORMING APPARATUS WITH REMOVABLE FEEDING UNIT

(71) Applicant: CANON KABUSHIKI KAISHA, Tokyo (JP)

(72) Inventors: Keisuke Yoshida, Kashiwa (JP); Takeshi Fukuda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/078,227

(22) Filed: Mar. 23, 2016

(65) Prior Publication Data

US 2016/0202650 A1 Jul. 14, 2016

Related U.S. Application Data

(63) Continuation of application No. PCT/JP2014/076340, filed on Sep. 25, 2014.

(30) Foreign Application Priority Data

Sep. 26, 2013 (JP) ..... 2013-199176
Sep. 8, 2014 (JP) ..... 2014-181876

(51) Int. Cl.
*G03G 21/16* (2006.01)
*G03G 15/20* (2006.01)
*G03G 15/00* (2006.01)

(52) U.S. Cl.
CPC ..... *G03G 15/2053* (2013.01); *G03G 15/2071* (2013.01); *G03G 15/80* (2013.01);
(Continued)

(58) Field of Classification Search
CPC ..... G03G 15/2053; G03G 21/1685; G03G 15/80; G03G 2215/2035; G03G 21/1652;
(Continued)

(56) References Cited

U.S. PATENT DOCUMENTS 9,201,367 B2 * 12/2015 Miyake ..... G03G 21/1633
2006/0115291 A1 * 6/2006 Chung ..... G03G 21/1867 399/90

(Continued)

FOREIGN PATENT DOCUMENTS

JP 0493874 A 3/1992
JP 04156560 A 5/1992

(Continued)

*Primary Examiner* — David M Gray
*Assistant Examiner* — Laura Roth
(74) *Attorney, Agent, or Firm* — Fitzpatrick, Cella, Harper & Scinto

(57) ABSTRACT

An image forming apparatus includes an apparatus main assembly having a door, a feeding unit including first and second rotatable members configured to form a nip for feeding a sheet and a moving mechanism configured to move the first rotatable member in a spacing direction relative to the second rotatable member, a power source provided in the apparatus main assembly, and a motor provided in the apparatus main assembly and configured to drive the moving mechanism. The feeding unit is detachably mountable to the apparatus main assembly upon opening of the door. An electric power supplying path is capable of supplying electric power from the power source to the motor via the feeding unit despite the door being in an open state.

20 Claims, 8 Drawing Sheets

(52) U.S. Cl.
CPC ..... *G03G 21/1652* (2013.01); *G03G 21/1685* (2013.01); *G03G 2215/2035* (2013.01); *G03G 2221/166* (2013.01); *G03G 2221/1639* (2013.01)

(58) Field of Classification Search
CPC ..... G03G 2221/166; G03G 2221/1639; G03G 15/2071
See application file for complete search history.

(56) References Cited

U.S. PATENT DOCUMENTS

| | | | | |
|---|---|---|---|---|
| 2007/0140710 | A1* | 6/2007 | Okano | G03G 15/55 399/13 |
| 2009/0232550 | A1* | 9/2009 | Obata | G03G 21/1685 399/122 |
| 2010/0329729 | A1* | 12/2010 | Koshida | G03G 15/2053 399/110 |
| 2014/0369709 | A1* | 12/2014 | Nakano | G03G 15/2017 399/88 |
| 2015/0093124 | A1* | 4/2015 | Miyake | G03G 21/1633 399/18 |

FOREIGN PATENT DOCUMENTS

| | | | |
|---|---|---|---|
| JP | 0916030 | A | 1/1997 |
| JP | 2000134787 | A | 5/2000 |
| JP | 2013164610 | A | 8/2013 |
| JP | 2013257413 | A | 12/2013 |

* cited by examiner

IMAGE FORMING APPARATUS WITH REMOVABLE FEEDING UNIT

TECHNICAL FIELD

The present invention relates to an image forming apparatus such as a copying machine, a printer, a facsimile machine or a multi-function machine having a plurality of functions of these machines.

BACKGROUND ART

Conventionally, in an electrophotographic image forming apparatus, a toner image is formed on a recording material (sheet) using an electrophotographic process and is fixed on the recording material by heating the recording material by a pair of rotatable members of a fixing device while nipping and feeding the recording material.

In such an image forming apparatus, a constitution in which electric power supply to a driving source for driving the fixing device is interrupted when an openable door is opened for permitting access to the fixing device has been proposed (see, Japanese Laid-Open Patent Application 2000-134787).

However, in the case of a constitution in which the electric power supply to the driving source for driving the fixing device is forcedly interrupted with opening of the openable door, for example, the electric power supply is interrupted also in the case where the openable door is opened for jam clearance (for removing a stagnated recording material by an operator). On the other hand, in order to facilitate a jam clearance operation by the operator, it is preferable that a state in which the pair of rotatable members is pressed against each other is eliminated or that the pair of rotatable members is placed in a light-pressure state. In such the background, when the openable door is erroneously opened, the electric power supply to the driving source is interrupted, so that transfer of the pair of rotatable members to the pressure-released state or the light-pressure state cannot be performed. Incidentally, such a problem can arise not only in the fixing device but also similarly in a feeding device for feeding the recording material.

SUMMARY OF THE INVENTION

According to the present invention, there is provided an image forming apparatus comprising: an apparatus main assembly including a door; a feeding unit including first and second rotatable members configured to form a nip for feeding a sheet and a moving mechanism configured to move the first rotatable member in a spacing direction from the second rotatable member, wherein the feeding unit is detachably mountable to the apparatus main assembly with opening of the door; a power source provided in the apparatus main assembly; a driving source, provided in the apparatus main assembly, configured to drive the moving mechanism; and an electric power supplying path capable of supplying electric power from the power source to the driving source via the feeding unit despite the door being in an open state.

EMBODIMENT FOR CARRYING OUT THE INVENTION

Figure 1:
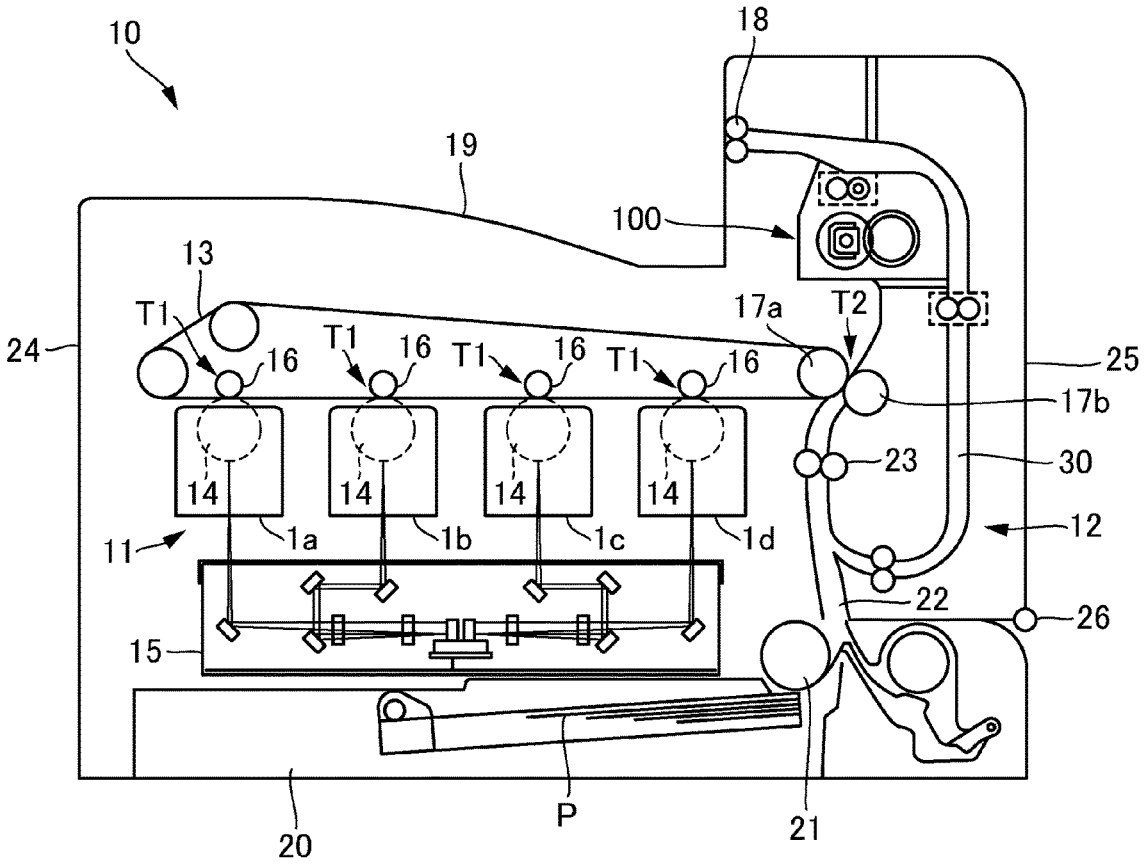
FIG. 1 is a schematic sectional view of an image forming apparatus.

An embodiment of the present invention will be described using FIG. 1 to FIG. 8. First, a schematic structure of an image forming apparatus in this embodiment will be described using FIG. 1.

[Image Forming Apparatus]

An image forming apparatus 10 in this embodiment is a full-color printer employing an electrophotographic type. Such an image forming apparatus 10 includes an image forming portion 11 for forming a toner image and a recording material feeding portion 12 for feeding a recording material (sheet) for transferring thereon the toner image formed by the image forming portion 11. Incidentally, as the recording material, it is possible to cite, for example, a transfer sheet, an electrofax sheet, electrostatic recording paper, an OHP sheet, printing paper, format paper, and so on. The image forming portion 11 has a constitution of a so-called tandem type in which a plurality of image forming stations 1*a*, 1*b*, 1*c*, 1*d* are arranged in a traveling direction of an intermediary transfer belt 13. At the image forming stations 1*a*, 1*b*, 1*c*, 1*d*, toner images of yellow, magenta, cyan, and black are formed, respectively. In the case of this embodiment, each of the respective image forming stations 1*a*, 1*b*, 1*c*, 1*d* is constituted by a process cartridge.

At each of the image forming stations, the toner image is formed in the following manner. First, a surface of a photosensitive drum 14 is electrically charged by a charging device such as a charging roller, and the charged surface of the photosensitive drum 14 is exposed by an exposure device 15 to light depending on image information by a laser or the like, so that an electrostatic latent image is formed. Then, the electrostatic latent image is developed with a toner by a developing device, so that the toner image is formed on the surface of the photosensitive drum 14.

The toner images formed on the surfaces of the photosensitive drums 14 of the respective image forming stations are successively transferred superposedly on the intermediary transfer belt 13 at primary transfer portions T1, so that a full-color toner image is formed on the intermediary transfer belt 13. At the primary transfer portion T1, a primary transfer roller 16 as a primary transfer portion is disposed opposed to the photosensitive drum 14 while sandwiching the intermediary transfer belt 13 therebetween. Then, by applying a primary transfer bias between the primary transfer roller 16 and the photosensitive drum 14, the toner image on the photosensitive drum 14 is transferred onto the intermediary transfer belt 13.

The toner images on the intermediary transfer belt 13 are transferred onto a recording material P fed by a recording material feeding portion 12 at a secondary transfer portion T2. At the secondary transfer portion T2, an inner secondary transfer roller 17*a* and an outer secondary transfer roller 17*b* which are provided opposed to each other while sandwiching the intermediary transfer belt 13 therebetween are disposed. Then, by applying a secondary transfer bias between the inner secondary transfer roller 17*a* and the outer secondary transfer roller 17*b*, the toner images on the intermediary transfer belt 13 are transferred onto the recording material P. The recording material P on which the toner images are transferred is heated and pressed by a fixing device 100 as a heating device, so that the toner images are fixed. Details of the fixing device 100 will be described later. The recording material P on which the toner images are fixed is discharged onto a discharge tray 19 by a discharging roller 19.

The recording material feeding portion 12 is constituted by a plurality of feeding rollers, and the recording material P accommodated in a cassette 20 is picked up by a pick-up roller 21 and is fed to a feeding path 22. The recording material P fed to the feeding path 22 is fed to the secondary transfer portion T2 by a registration roller pair 23 by being timed to the toner images formed on the image forming portion 11. Further, the recording material P discharged from the fixing device 100 is reversed for effecting double-side printing and is fed to a reverse feeding path 30 in addition to the discharge onto the discharge tray 19 as described above. The recording material P fed through the reverse feeding path 30 merges with the feeding path 22 and is fed to the secondary transfer portion T2 similarly as described above.

Further, in the case of this embodiment, on an apparatus main assembly 24 in which the above-described various devices are disposed, an openable door 25 for permitting access to internal parts (components) is provided so as to open and close freely. The openable door 25 is provided rotatably about a rotation shaft 26 on a side where the feeding path 22 and the fixing device 100 are disposed. Then, by opening the openable door 25, the fixing device 100 and the feeding path 22 are exposed, so that mounting and demounting of the fixing device 100 and removal of a jammed recording material become possible. For this reason, the fixing device 100 is provided so as to be detachably mountable to the apparatus main assembly 24. A one-side roller of a feeding roller pair such as the registration roller pair 23 is disposed in the feeding path 22, and the outer secondary transfer roller 17*b* constituting the secondary transfer portion T2 is provided on the openable door 25 side. Further, when the openable door 25 is opened, these rollers are spaced from the opposing rollers and the intermediary transfer belt 13.

[Fixing Device]

Figure 2:
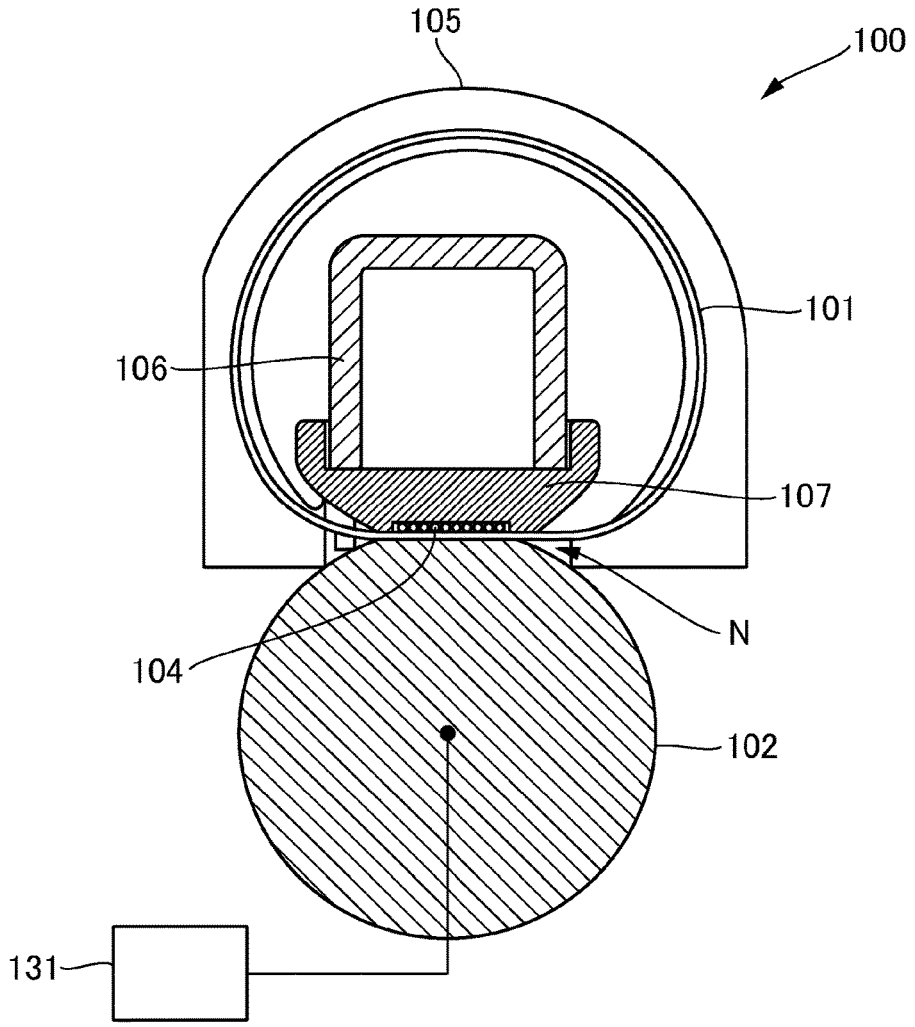
FIG. 2 is a schematic sectional view of a fixing device.

Next, details of the fixing device (image heating apparatus) 100 functioning as a feeding unit for nipping and feeding the recording material (sheet) will be described using FIG. 2 and FIG. 3. The fixing device 100 includes a pair of rotatable members, i.e., a fixing film 101 and an opposite roller 102 disposed opposed to this fixing film 101. Between these fixing film 101 and opposite roller 102, a nip (portion) N through which the recording material is nipped and fed is formed, and the toner images formed on the recording material passing through the nip N are heated by a heater 104 as a heating source. Further, a pressure (pressure at the nip N) exerted between the fixing film 101 and the opposite roller 102 is substantially capable of being eliminated (a pressure during fixing at the nip N is eliminated or reduced) by a pressure eliminating mechanism 103.

The fixing film 101 is a cylindrical heat-resistant member obtained by forming an elastic layer on a base layer of a cylindrical thin metal, and is loosely fitted in locus-regulating members 105 disposed at both end portions of the fixing film 101. With respect to such a fixing film 101, in order to improve a quick start property by making a thermal capacity small, a film thickness is made 100 μm or less, preferably 20 μm or more and 50 μm or less. The fixing film 101 may also be a film including a base layer formed of metal such as SUS or may also be a single-layer film such as PTFE, PFA or FEP which have a heat-resistant property. Or, the fixing film 101 may also be a composite-layer film including a base layer of polyimide, polyamideimide, PEEK, PES, PPS or the like and a coating or coated layer of PTFE, PFA, FEP or the like on an outer peripheral surface of the base layer.

The opposite roller 102 is constituted by a core metal consisting of metal such as iron and a heat-resistant elastic material layer, molded and coated concentrically integrally about the core metal, formed of a silicone rubber, a fluorine-containing rubber or a fluorine-containing resin, and a parting layer is provided as a surface layer. For example, as a material for the parting layer, it is possible to select a material, having a good parting property and a good heat-resistant property, such as a fluorine-containing resin, a silicone resin, a fluorine silicon rubber, a fluorine-containing rubber or a silicone rubber. At both end portions of the core metal, unshown pressing member supporting members consisting of a heat-resistant resin such as PEEK, PPS or a liquid crystal polymer are mounted and rotatably supported. Further, the opposite roller 102 is driven by a motor 131, as a driving source, provided in the apparatus main assembly 24. The fixing film 101 is rotated by rotationally driving the opposite roller 102, and feeds the recording material nipped in the nip N.

As described above, the locus-regulating members 105 fitted in the fixing film 101 at the both end portions of the fixing film 101 are members consisting of PET, PPS, LCP or the like which is the heat-resistant resin. Such a locus-regulating member 105 is movably supported by a side plate of the fixing device 100, and not only rotatably supports the fixing film 101 but also is disposed in a casing of the fixing device 100. Then, the locus-regulating member 105 not only guides rotation of the fixing film 101 but also functions as an abutting portion of the fixing film 101 in a longitudinal direction (direction crossing a recording material feeding direction at the nip N).

Inside the fixing film 101, a stay 106 is disposed along the longitudinal direction, and both end portions of the stay 106 are supported by the locus-regulating members 105. Such a stay 106 is a member principally consisting of a metal such as iron or SUS. Further, on an opposite roller 102 side of the stay 106, a press-contact member 107 is disposed. Further, by pressing the stay 106 against the press-contact member 107 made by a relatively soft resin, the press-contact member 107 is caused to have a strength with respect to the longitudinal direction (direction crossing the recording material feeding direction at the nip N) and the press-contact member 107 is rectified.

The press-contact member 107 is a heat-resistant and heat-insulating member having a substantially semi-circular shape in cross-section. For example, the press-contact member 107 is formed of a material, having a good insulating property and a good heat-resistant property, such as a phenolic resin, a polyimide resin, a polyamide resin, a polyamideimide resin, PEEK resin, PES resin, PPS resin, PFA resin, PTFE resin or LCP resin. Further, the press-contact member 107 performs functions of backing-up the fixing film 101, being press-contacted against the fixing film 101 toward the opposite roller 102 and realizing feeding stability of the fixing film 101 during rotation.

A ceramic heater (herein after referred to as a heater) 104 as a heating source is supported by the press-contact member 107. The heater 104 is engaged in a groove formed on a surface of the press-contact member 107 on the nip N side along the longitudinal direction and is supported. The heater 104 includes, as a basic structure, an elongated thin plate-like ceramic substrate and an electric power supplying heat generating resistor layer, and is a low thermal capacitance heater increasing in temperature with an abrupt rising characteristic as a whole by electric power supply to the heat generating resistor layer.

Further, in the case of this embodiment, the fixing film 101 is pressed toward the opposite roller 101 by a pressing member 108, so that the above-described nip N is formed. Such a pressing member 108 stretches a spring 109 as a pressing elastic member as shown in FIG. 3, and by an elastic force of the spring 109, the locus-regulating member 105 is urged (pressed against) toward the opposite roller 102. Accordingly, the pressing member 108 presses the press-contact member 107 toward the opposite roller 102 via the locus-regulating member 105 and the stay 106. The press-contact member 107 is pressed, so that the above-described nip N is formed between the fixing film 101 and the opposite roller 102.

The pressure eliminating mechanism 103 functioning as a moving mechanism moves the above-described pressing member 108 to switch a state of the fixing film 101 and the opposite roller 102 between a state in which the fixing film 101 and the opposite roller 102 are pressed at the nip N and a state in which this (pressed) state is eliminated (a state in which the pressure is substantially eliminated or a state in which the pressure is lighter than that during the fixing). Such a pressure eliminating mechanism 103 includes a cam 103*a* and a cam contact surface 103*b* contacting a cam surface of the cam 103*a* formed on the pressing member 108. The cam 103*a* is driven by a motor 131, as a driving source, provided in the apparatus main assembly 24 and described later, and performs pressure application and pressure (application) elimination of the nip N (the pressure at the nip N during the fixing is eliminated or reduced) by causing the cam surface to contact or be spaced from the cam contact surface 103*b* of the pressing member 108.

Figure 3:
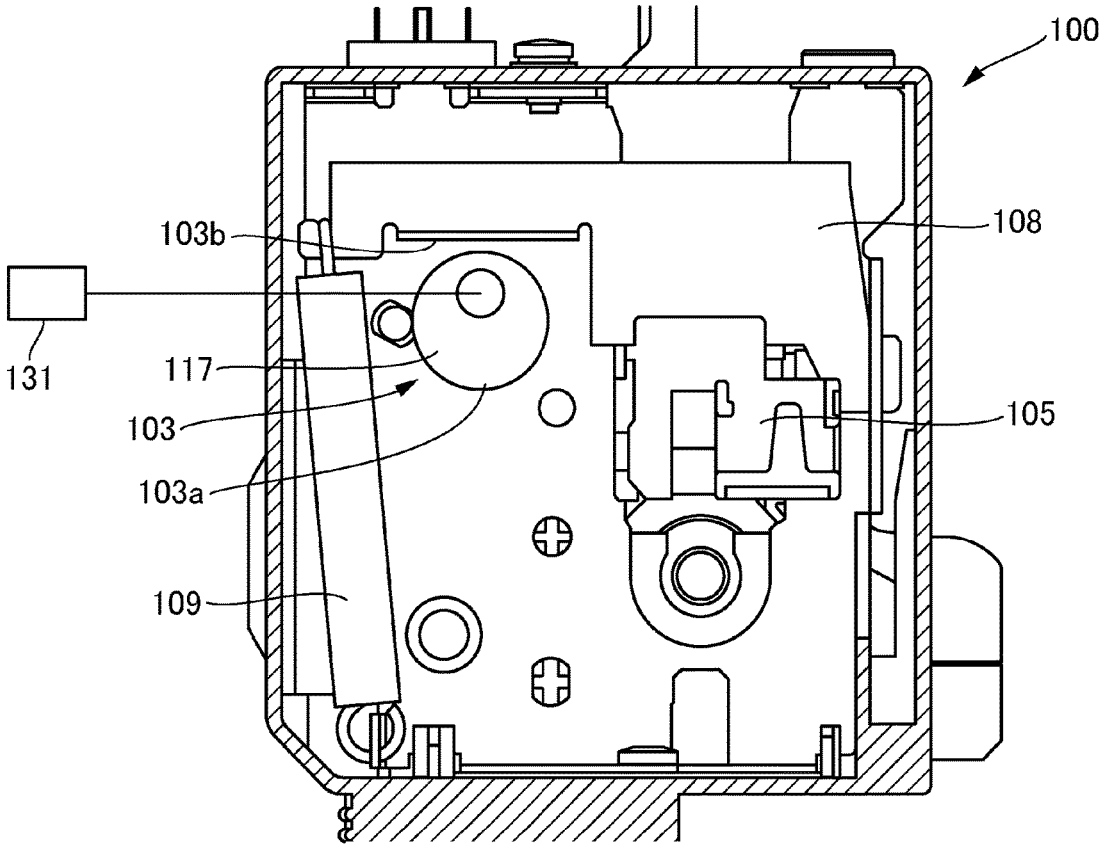
FIG. 3 is a sectional view showing a pressure eliminating mechanism of the fixing device.

During the pressure application of the nip N, as shown in FIG. 3, a phase of the cam 103*a* is set so that the cam contact surface 103*b* of the pressing member 108 does not contact the cam surface of the cam 103*a*. By this, the pressing member 108 presses the locus-regulating member 105 by an elastic force of the spring 109, so that the nip N is pressed.

On the other hand, during the pressure elimination, the cam 103*a* rotates substantially 180 deg. from the state of FIG. 3, and the cam surface of the cam 103*a* contacts the cam contact surface 103*b* of the pressing member, so that the cam 103*a* pushes up the pressing member 108 against the elastic force of the spring 109. By this, the pressure application at the nip N is substantially eliminated (the pressure at the nip N during the fixing is eliminated or reduced).

[Mounting and Demounting of Fixing Device]

Figure 4:
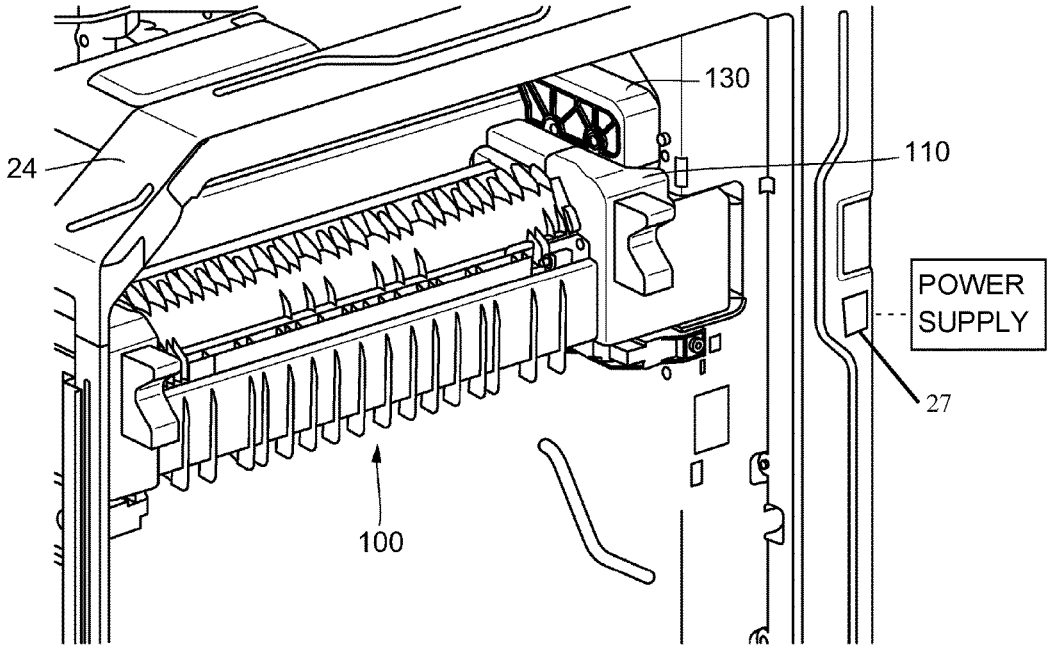
FIG. 4 is a perspective view showing a state in which the fixing device is mounted in an apparatus main assembly.
Figure 5:
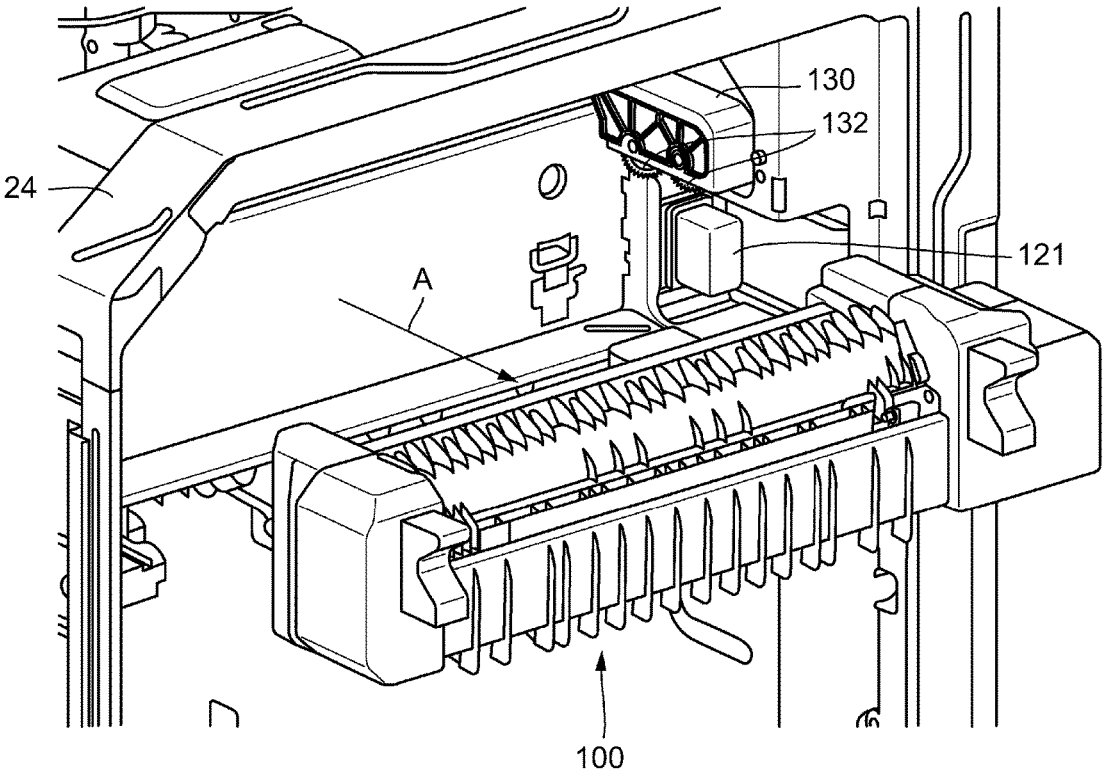
FIG. 5 is a perspective view showing a state in which the fixing device is demounted from the apparatus main assembly.

As described above, the fixing device 100 is detachably mountable to the apparatus main assembly 24 as shown in FIGS. 4 and 5. That is, by opening the openable door 25 shown in FIG. 1, as shown in FIG. 4, the fixing device 100 mounted in the apparatus main assembly 24 is exposed. Then, as shown in FIG. 5, by pulling-out the fixing device 100 in an arrow A direction, the fixing device 100 can be demounted from the apparatus main assembly 24. On the other hand, when the fixing device 100 is mounted in the apparatus main assembly 24, the fixing device 100 is pushed in an opposite direction to the arrow A direction in FIG. 5.

Figure 6:
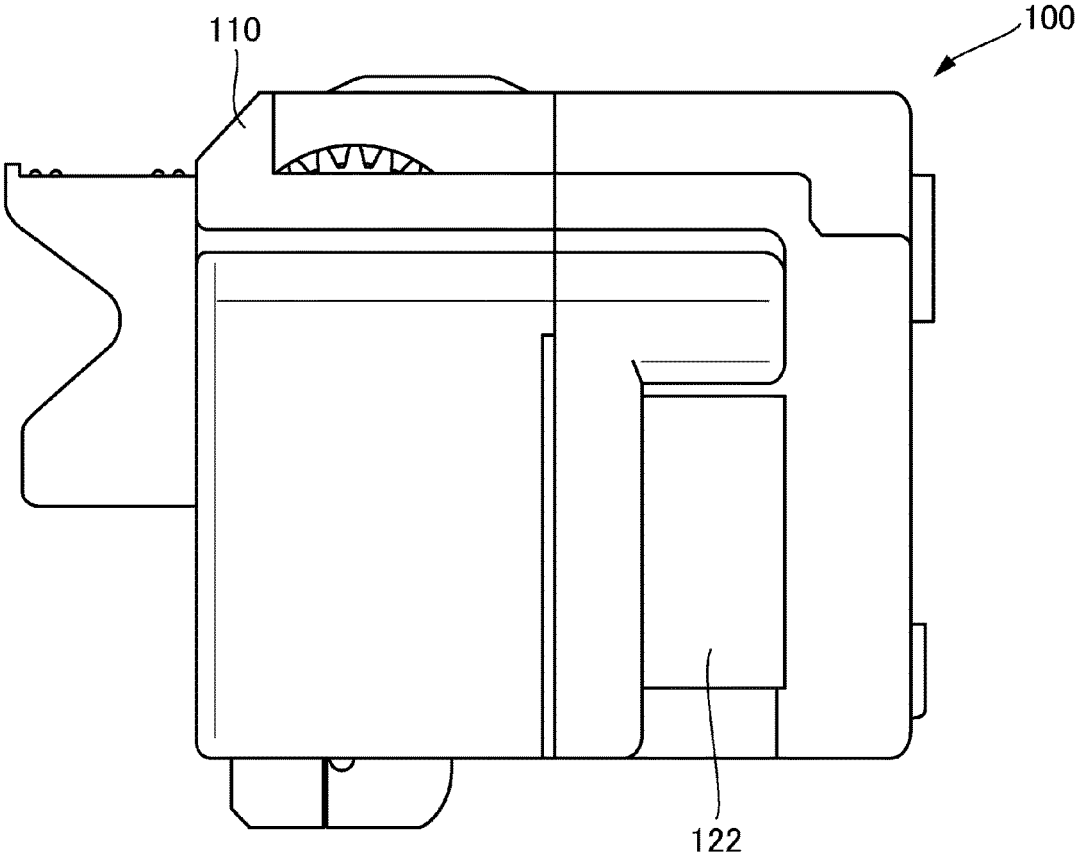
FIG. 6 is a side view of the fixing device.

Further, during the mounting and the demounting of such a fixing device 100, a first connector 121 (main assembly-side connector) shown in FIG. 5 and provided in the apparatus main assembly 24 and a second connector (unit-side connector) 122 shown in FIG. 6 and provided on the fixing device 100 are detachably mountable to each other. Further, by connection of the first connector 121 and the second connector 122, an electric power supplying path 123 as shown in FIG. 7 is formed.

[Effect Power Supplying Path]

Figure 7:
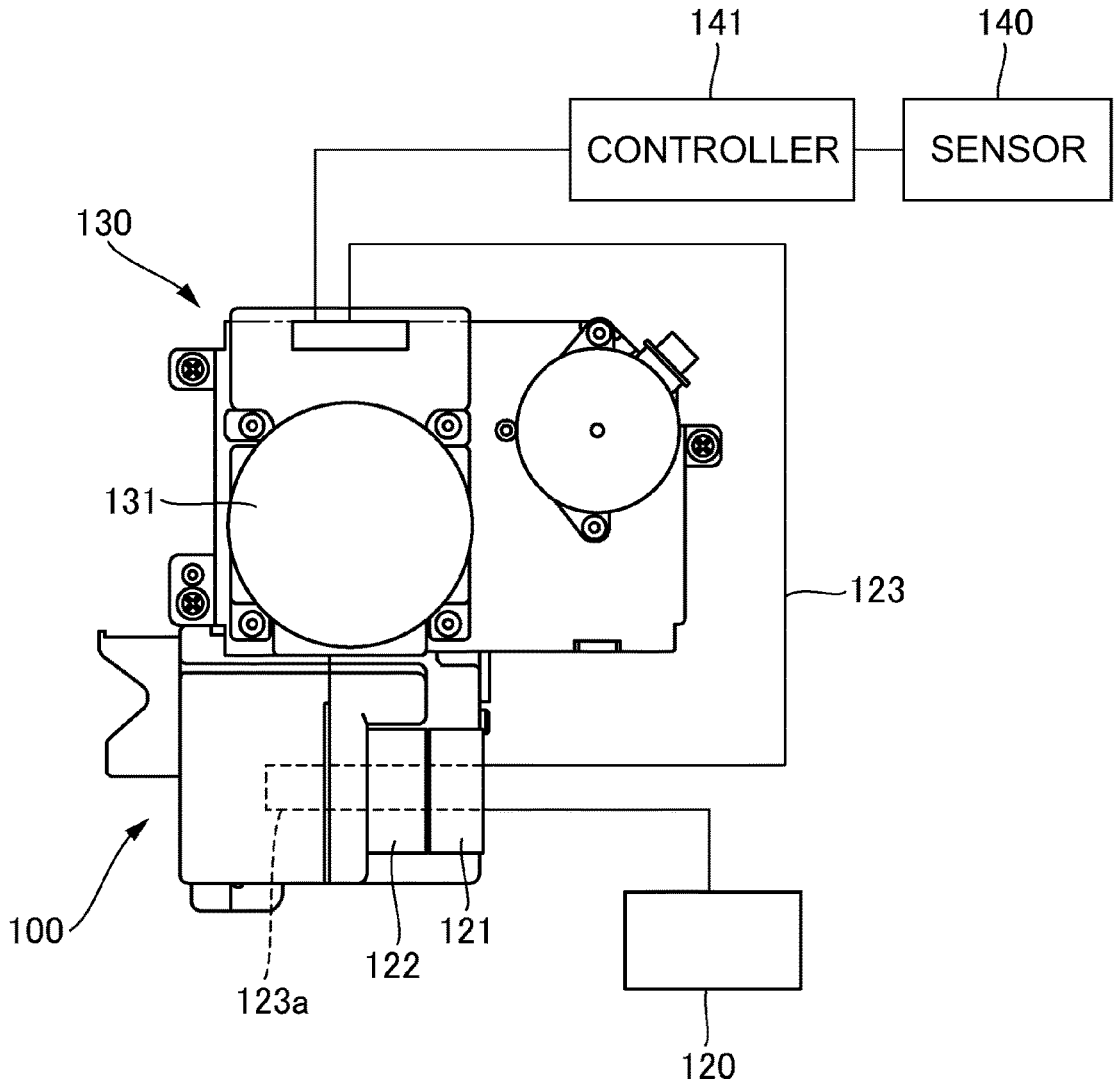
FIG. 7 is a schematic view showing an electric power supplying path in the state in which the fixing device is mounted in the apparatus main assembly.

The electric power supplying path 123 supplies, as shown in FIG. 7, electric power from a power source 120 provided in the apparatus main assembly 24 to the motor 131 via an inside of the fixing device 100 (inside of the heating device) mounted in the apparatus main assembly 24. That is, the electric power supplying path 123 includes the first connector 121 and the second connector 122 and supplies the electric power from the power source 120 to the motor 131 via the first connector 121 and the second connector 122. For this reason, inside the fixing device 100, a by-pass portion 123*a* is formed as a part of the electric power supplying path 123. Further, the electric power supplied from the power source 120 into the fixing device 100 via the first connector 121 and the second connector 122 is sent through the by-pass portion 123*a* to be returned to the apparatus main assembly 24 side via the first connector 121 and the second connector 122 again. In this way, the electric power returned to the apparatus main assembly 24 side is sent to the motor 131 of a fixing (device) driving portion 130 provided in the apparatus main assembly 24, and drives the mount 131. Accordingly, the electric power supplying path 123 supplies the electric power from the power source 120 to the motor 131 in a state in which the fixing device 100 is mounted in the apparatus main assembly 24 and the first connector 121 and the second connector 122 are connected with each other.

Incidentally, as the first connector 121 and the second connector 122, drawer connectors are used in an illustrated example, but if connectors can satisfy an equivalent function, the first and second connectors are not limited thereto. For example, such a type that a leaf spring member having elasticity is contacted to a metal plate member constituting a contact (point) or the like type may also be employed.

Here, the apparatus main assembly 24 is provided with a plurality of doors including the openable door 25 and includes interlock switches 27 which interrupt the electric power supply from the power source to the image forming portion 11 and the recording material feeding portion 12 by opening the doors. Accordingly, for example, when the openable door for permitting access to the image forming portion 11 is opened, the electric power supply to the image forming portion 11 is forcedly interrupted. Or, when the openable door for permitting the access to the image forming portion 11 is opened, a state in which the electric power supply to the image forming portion 11 cannot be made is formed. Such a constitution is similar also for the recording material feeding portion 12. Incidentally, the interlock switch extends via the electric power supplying path toward the heater 104 of the fixing device 100 and interrupts the electric power supply to the heater 104 by the opening of any of the doors including the openable door 25.

However, in this embodiment, the electric power supplying path 123 toward the motor 131 of the fixing driving portion 130 does not extend via all of the interlock switches.

Accordingly, the electric power supplying path 123 is capable of supplying the electric power from the power source 120 to the motor 131 irrespective of the opening and the closing of the openable door 25. That is, even when the openable door 25 is opened, if the fixing device 100 is mounted in the apparatus main assembly 24, a state in which the electric power is supplied to the motor 131 is formed. Particularly, in the case of this embodiment, the electric power supplying path 123 does not extend via all of the interlock switches, and therefore the motor 131 can be operated irrespective of the open or closed state of all of the doors.

Further, in the case of this embodiment, with the opening of the openable door 25, the motor 131 is driven to eliminate the pressure application at the nip N. Particularly, in this embodiment, in the case where any of the doors of the plurality of the doors including the openable door 25 is opened, the pressure application at the nip N is eliminated. For this reason, all of the doors are provided with sensors 140 (FIG. 7) for detecting that the doors are opened. Further, in the case where the nip N is in the pressed state when the sensor 140 detects the opening of the door, a control portion (controller) 141 (FIG. 7) drives the pressure eliminating mechanism 103 by rotating the motor 131, and switches the nip N into a pressure-eliminated state. Incidentally, the pressed state of the nip N can be detected from a phase of the cam 103*a*, for example.

Figure 8:
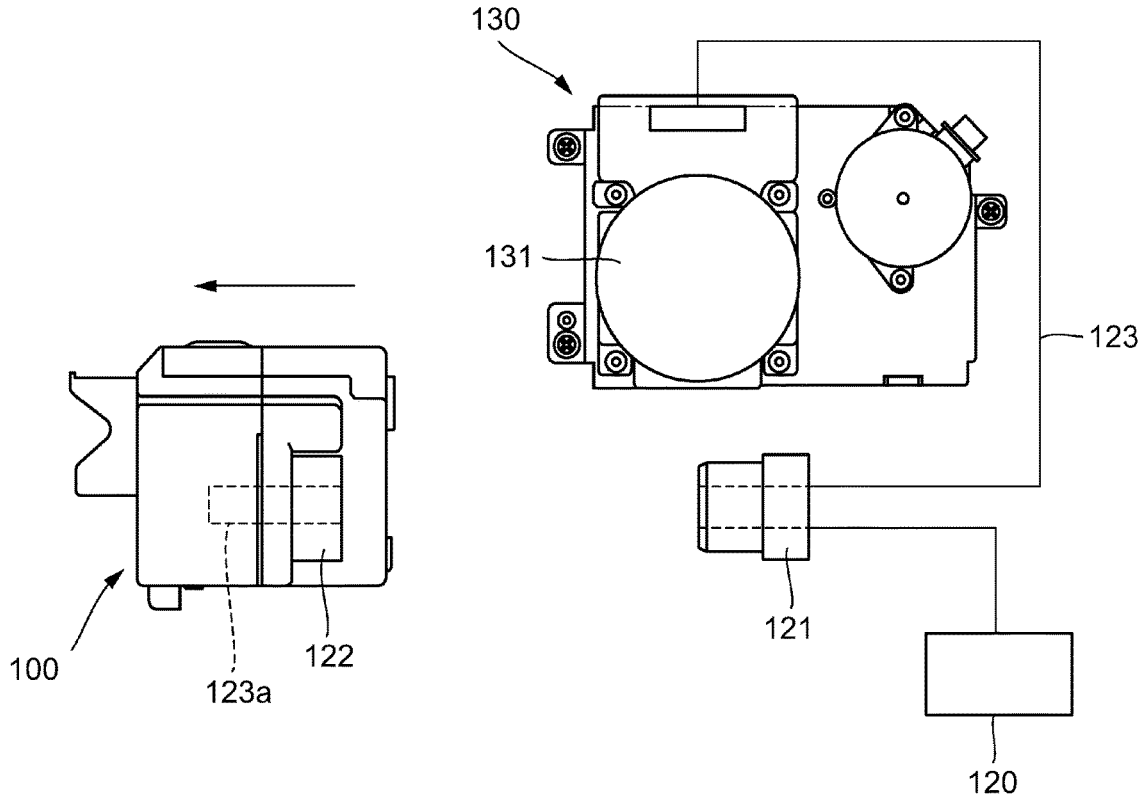
FIG. 8 is a schematic view showing the electric power supplying path in the state in which the fixing device is demounted from the apparatus main assembly.

On the other hand, as shown in FIG. 5, in the case where the fixing device 100 is demounted from the apparatus main assembly 24, as shown in FIG. 8, the first connector 121 and the second connector 122 are separated from each other and are in a non-contact state. As a result, the electric power supplying path 123 from the power source 120 to the motor 131 is interrupted, so that the electric power is not supplied from the power source 120 to the motor 131.

[Driving Path of Fixing Device]

Here, as shown in FIGS. 4 and 5, the fixing driving portion 130 for driving the fixing device 100 is provided in the neighborhood of the fixing device 100 mounted in the apparatus main assembly 24. The fixing driving portion 130 includes the motor 131 and, as described above, is capable of transmitting power of the motor 131 to the opposite roller 102 and the pressure eliminating mechanism 103. For this reason, the fixing driving portion 130 includes two driving gears 132 for transmitting the power of the motor 131 to the opposite roller 102 and the pressure eliminating mechanism 103, respectively. The two driving gears 132 engage with a gear connected with the opposite roller 102 and a gear connected with the cam 103*a* of the pressure eliminating mechanism 103, respectively, which are provided on the fixing device 100 side. Further, inside the fixing driving portion 130, a switching mechanism for switching the drive transmitting path of the motor 131 into the two driving gears 132 is provided, and is capable of transmitting the power of the motor 131 to either of the driving gears 132 by an instruction of the controller 141.

Accordingly, in the case where the recording material is fed to the nip N and the toner image on the recording material is heated, the controller 141 switches the path to a path for transmitting the power of the motor 131 to the opposite roller 102. On the other hand, in the case where the pressure elimination of the nip N is made, the controller 141 switches the path to a path for transmitting the power of the motor 131 to the cam 103*a*.

In this way, the driving gears 132, of the fixing driving portion 130, provided in the apparatus main assembly 24 are, as shown in FIG. 4, covered with a protective wall portion 110 as a covering portion for the fixing device 100 in a state in which the fixing device 100 is mounted in the apparatus main assembly 24. The protective wall portion 110 is projected and formed toward a side where the drive transmission from the driving gears 132 of the fixing device 100 is effected. Further, in the state in which the fixing device 100 is mounted in the apparatus main assembly 24, a periphery of the driving gears 132 is covered with the protective wall portion 110. The protective wall portion may also be provided on the fixing driving portion 130 side so as not to interfere with the fixing device 100 during the mounting and the demounting of the fixing device 100.

As described above, in the state in which the fixing device 100 is mounted in the apparatus main assembly 24, even when the openable door 25 is opened, the electric power is supplied to the motor 131, and therefore a state in which the motor 131 is driven and the driving gears 132 are rotatable is formed. Accordingly, by providing the protective wall portion 110 as described above, even when the operator opens the openable door 25 during jam clearance or during exchange (replacement) of the fixing device 100, the operator is prevented from touching the driving gears 132.

On the other hand, in the case where the fixing device 100 is demounted from the apparatus main assembly 24, as shown in FIG. 5, the driving gears 132 are exposed, and therefore a state in which the operator is capable of touching the driving gears 132 is formed. In this embodiment, as described above, the electric power supplying path 123 from the power source 120 to the motor 131 is formed so as to extend via the fixing device 100, and therefore in a state in which the fixing device 100 is demounted from the apparatus main assembly 24, a state in which the electric power is not supplied to the motor 131 is formed. Accordingly, as shown in FIG. 5, even when the driving gears 132 are exposed, the driving gears 132 do not rotate.

In the case of this thus constituted embodiment, irrespective of the opening and the closing of the openable door 25, the electric power is supplied from the power source 120 to the motor 131. For this reason, although the openable door 25 is in the open state, the pressure eliminating mechanism 103 can be driven by the motor 131. By doing so, for example, even in the case where the openable door 25 is opened during a printing operation and an operation of the image forming apparatus 100 stops partway and the (printing) operation stops in a state in which the recording material is nipped in the nip N, the pressure elimination of the nip N can be performed (the pressure at the nip N during the fixing is eliminated or reduced) by driving the motor 131. As a result of this, an operating force for removing the recording material remaining in the nip N can be made small, so that it is possible to prevent impartment of damage to the fixing device 100 in a state in which the recording material is torn and left in the main assembly or the fixing device 100 is pulled by the recording material to be removed.

Further, in the case of this embodiment, the electric power supplying path 123 extends via the inside of the fixing device 100, and therefore in the case where the fixing device 100 is demounted from the apparatus main assembly 24, the electric power supply to the motor 131 is interrupted. For this reason, even when the driving portion such as the driving gears 132 is exposed by demounting the fixing device 100 from the apparatus main assembly 24, the driving portion is not driven.

Other Embodiments

In the above-described embodiment, as the fixing device, the case where a constitution of the film heating type is used was described, but the present invention is not limited to such a film fixing type fixing device, and for example, is applicable to also a fixing device using another constitution such as a roller or a belt.

Further, the motor 131 as the driving source has a constitution, in the above-described embodiment, in which both of the pressure eliminating mechanism 103 and the opposite roller 102 are driven, but may only be required to drive at least the pressure eliminating mechanism 103. In the case where only the pressure eliminating mechanism 103 is driven by the motor 131, the opposite roller 102 is to be driven by another driving source, but the electric power supply to this driving source may also be effected without going through the inside of the fixing device as in the electric power supplying path 123. That is, the driving source for feeding the recording material at the nip may also be constituted so that the electric power supply is interrupted when the openable door is opened. Further, in the above, an example in which the fixing device (feeding unit) is provided with a by-pass like electric power supplying path was described, but the present invention is not limited thereto, and a similar constitution (in which the by-pass like electric power supplying path is provided) may also be applied to the recording material feeding portion 12. Specifically, with respect to a rotatable member pair, for nipping and feeding the recording material, provided in the recording material feeding portion 12 as the feeding unit, when the openable door for permitting access to the recording material feeding portion 12 is opened, as long as the recording material feeding portion 12 is mounted in the image forming apparatus, the recording material feeding portion 12 can be driven by the driving source.

INDUSTRIAL APPLICABILITY

According to the present invention, an image forming apparatus, in which even when an access door is opened during image formation, electric power supply to a necessary portion is maintained, is provided.

The invention claimed is:

1. An image forming apparatus comprising:

an apparatus main assembly including a door;

a feeding unit including first and second rotatable members configured to form a nip for feeding a sheet and a moving mechanism configured to move the first rotatable member in a spacing direction relative to the second rotatable member, wherein said feeding unit is detachably mountable to said apparatus main assembly when the door is in an open state;

a power source provided in said apparatus main assembly;

a motor, provided in said apparatus main assembly, configured to drive the moving mechanism; and an electric power supplying path capable of supplying electric power from said power source to said motor via said feeding unit despite the door being in the open state.

2. An image forming apparatus according to claim 1, further comprising a main assembly-side connector provided in said apparatus main assembly and a unit-side connector, provided on said feeding unit, capable of connecting with said main assembly-side connector with a mounting operation of said feeding unit into said apparatus main assembly, wherein said electric power supplying path includes a first path from said power source to said main assembly-side connector, a second path from one portion of said unit-side connector connected with the first path to another portion of said unit-side connector via said feeding unit, and a third path from a portion of said main assembly-side connector connected with the second path to said motor.

3. An image forming apparatus according to claim 1, further comprising a sensor configured to detect opening of the door and a controller configured to supply electric power from said power source to said motor via said feeding unit in order to move the first rotatable member in the spacing direction from the second rotatable member in a case where a predetermined pressure is exerted between the first and second rotatable members when the opening of the door is detected by said sensor.

4. An image forming apparatus according to claim 3, further comprising an image forming portion, provided in said apparatus main assembly, configured to form an image, wherein said controller interrupts electric power supply to said image forming portion with opening of the door.

5. An image forming apparatus according to claim 3, wherein the moving mechanism substantially eliminates the predetermined pressure exerted between the first and second rotatable members by a driving force received from said motor.

6. An image forming apparatus according to claim 5, further comprising a pressing member configured to press the first rotatable member toward the second rotatable member and a cam portion configured to move said pressing member by the driving force received from said motor.

7. An image forming apparatus according to claim 1, further comprising a heater configured to fix a toner image formed on the sheet at the nip.

8. An image forming apparatus comprising:

an apparatus main assembly including a door;

a feeding unit including first and second rotatable members configured to form a nip for feeding a sheet and a moving mechanism configured to move the first rotatable member in a spacing direction relative to the second rotatable member, wherein said feeding unit is detachably mountable to said apparatus main assembly when the door is in an open state;

a power source provided in said apparatus main assembly; and a motor, provided in said apparatus main assembly, configured to drive the moving mechanism, wherein said feeding unit includes an electric power supplying path configured to output electric power inputted from said power source to said motor.

9. An image forming apparatus according to claim 8, further comprising a main assembly-side connector provided in said apparatus main assembly and a unit-side connector, provided on said feeding unit, capable of connecting with said main assembly-side connector with a mounting operation of said feeding unit into said apparatus main assembly, wherein said electric power supplying path is connected with a path from said power source to said unit-side connector via said main assembly-side connector and is connected with a path from said unit-side connector to said motor via said main assembly-side connector.

10. An image forming apparatus according to claim 8, further comprising a sensor configured to detect opening of the door and a controller configured to supply electric power from said power source to said motor via said feeding unit in order to move the first rotatable member in the spacing direction from the second rotatable member in a case where a predetermined pressure is exerted between the first and second rotatable members when the opening of the door is detected by said sensor.

11. An image forming apparatus according to claim 10, further comprising an image forming portion, provided in said apparatus main assembly, configured to form an image, wherein said controller interrupts electric power supply to said image forming portion with opening of the door.

12. An image forming apparatus according to claim 10, wherein the moving mechanism substantially eliminates the predetermined pressure exerted between the first and second rotatable members by a driving force received from said motor.

13. An image forming apparatus according to claim 10, further comprising a pressing member configured to press the first rotatable member toward the second rotatable member and a cam portion configured to move said pressing member by a driving force received from said motor.

14. An image forming apparatus according to claim 8, further comprising a heater configured to fix a toner image formed on the sheet at the nip.

15. An image forming apparatus comprising:

an apparatus main assembly including a door;

a feeding unit including first and second rotatable members configured to form a nip for feeding a sheet and being detachably mountable to said apparatus main assembly when the door is in an open state;

a power source provided in said apparatus main assembly;

a motor, provided in said apparatus main assembly, configured to drive said feeding unit; and an electric power supplying path capable of supplying electric power from said power source to said motor via said feeding unit despite the door being in the open state.

16. An image forming apparatus according to claim 15, further comprising a main assembly-side connector provided in said apparatus main assembly and a unit-side connector, provided on said feeding unit, capable of connecting with said main assembly-side connector with a mounting operation of said feeding unit into said apparatus main assembly, wherein said electric power supplying path includes a first path from said power source to said main assembly-side connector, a second path from one portion of said unit-side connector connected with the first path to another portion of said unit-side connector via said feeding unit, and a third path from a portion of said main assembly-side connector connected with the second path to said motor.

17. An image forming apparatus according to claim 15, further comprising a heater for fixing a toner image formed on the sheet at the nip.

18. An image forming apparatus comprising:

an apparatus main assembly including a door;

a feeding unit including first and second rotatable members configured to form a nip for feeding a sheet and being detachably mountable to said apparatus main assembly when the door is in an open state;

a power source provided in said apparatus main assembly; and a motor, provided in said apparatus main assembly, configured to drive said feeding unit, wherein said feeding unit includes an electric power supplying path configured to output electric power inputted from said power source to said motor.

19. An image forming apparatus according to claim 18, further comprising a main assembly-side connector provided in said apparatus main assembly and a unit-side connector, provided on said feeding unit, capable of connecting with said main assembly-side connector with a mounting operation of said feeding unit into said apparatus main assembly, wherein the electric power supplying path is connected with a path from said power source to said unit-side connector via said main assembly-side connector and is connected with a path from said unit-side connector to said motor via said main assembly-side connector.

20. An image forming apparatus according to claim 18, further comprising a heater for fixing a toner image formed on the sheet at the nip.

* * * * *